US008864582B2

(12) United States Patent
Anderson et al.

(10) Patent No.: US 8,864,582 B2
(45) Date of Patent: Oct. 21, 2014

(54) WAGERING GAMES WITH ATTRACT PACKAGE SCHEDULING

(75) Inventors: Peter R. Anderson, Glenview, IL (US); Kevin Kahley, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 1621 days.

(21) Appl. No.: 12/280,006

(22) PCT Filed: Feb. 20, 2007

(86) PCT No.: PCT/US2007/004552

§ 371 (c)(1),
(2), (4) Date: Aug. 2, 2010

(87) PCT Pub. No.: WO2007/098225

PCT Pub. Date: Aug. 30, 2007

(65) Prior Publication Data

US 2010/0285868 A1 Nov. 11, 2010

Related U.S. Application Data

(60) Provisional application No. 60/743,324, filed on Feb. 20, 2006, provisional application No. 60/745,312, filed on Apr. 21, 2006.

(51) Int. Cl.
*A63F 9/24* (2006.01)
*G07F 17/32* (2006.01)

(52) U.S. Cl.
CPC ..... *G07F 17/323* (2013.01); *G07F 17/32* (2013.01)
USPC ..... 463/31; 463/16; 463/17; 463/18; 463/19; 463/20; 463/42

(58) Field of Classification Search
CPC . A63F 13/00; A63F 2300/5506; G07F 17/32; G07F 17/3211; G07F 17/323; G07F 17/0014; G07F 17/3255
USPC ..... 463/16–20, 31, 42
See application file for complete search history.

(56) References Cited

U.S. PATENT DOCUMENTS

| | | | | |
|---|---|---|---|---|
| 6,669,564 | B1 * | 12/2003 | Young et al. | 463/42 |
| 2001/0052000 | A1 * | 12/2001 | Giacalone, Jr. | 709/218 |
| 2003/0054881 | A1 * | 3/2003 | Hedrick et al. | 463/29 |
| 2004/0102248 | A1 * | 5/2004 | Young et al. | 463/42 |
| 2004/0116178 | A1 * | 6/2004 | Okada | 463/20 |
| 2004/0248642 | A1 | 12/2004 | Rothschild | |
| 2005/0215310 | A1 * | 9/2005 | Boyd et al. | 463/20 |
| 2006/0217178 | A1 * | 9/2006 | Walker et al. | 463/16 |
| 2006/0229122 | A1 * | 10/2006 | Macke | 463/16 |

OTHER PUBLICATIONS

"Application Serial No. PCT/US2007/04552, International Search Report mailed Sep. 22, 2008", 3 pgs.
"Application Serial No. PCT/US2007/04552, Written Opinion mailed Sep. 22, 2008", 8 pgs.

* cited by examiner

*Primary Examiner* — Steve Rowland
(74) *Attorney, Agent, or Firm* — Nixon Peabody LLP

(57) ABSTRACT

Apparatus, systems, and methods to manage attract software package access, storage, and execution scheduling for wagering game machines. A wagering game machine may operate to determine the availability of one or more attract packages, as well as to determine whether any available attract packages comprise an active attract package based on one or more schedules. The gaming machine may access one or more of the available, active attract packages and present them. The attract packages and associated schedules can be loaded into the gaming machine using a number of mechanisms, including a server and a machine-readable medium.

22 Claims, 4 Drawing Sheets

WAGERING GAMES WITH ATTRACT PACKAGE SCHEDULING

RELATED APPLICATIONS

This patent application is a U.S. National Stage Filing under 35 U.S.C. 371 from International Patent Application Ser. No. PCT/US2007/004552, filed Feb. 20, 2007, and published on Aug. 30, 2007 as WO 2007/098225 A2, which claims the priority benefit of U.S. Provisional Patent Application Ser. No. 60/743,324 filed Feb. 20, 2006 and entitled "WAGERING GAME SYSTEM WITH ATTRACT SCHEDULING", and of U.S. Provisional Patent Application Ser. No. 60/745,312 filed Apr. 21, 2006 and entitled "WAGERING GAMES WITH ATTRACT PACKAGE SCHEDULING", the contents of which are incorporated herein by reference in their entirety.

COPYRIGHT

A portion of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2006, 2007, WMS Gaming, Inc.

FIELD

Embodiments of the inventive subject matter relate generally to wagering game machines, including attract package scheduling for wagering game machines.

BACKGROUND

Wagering game makers, and wagering game machine manufacturers, strive to attract users to play games on the machines that are provided. Some users may consider the constant re-play of splash screens and sequences associated with currently available games on a particular machine to be repetitive and monotonous. Thus there is a need for improved apparatus, systems, and methods related to attracting players to wagering game machines.

DETAILED DESCRIPTION

Example Operating Environment

In order to increase the interest of potential players in wagering game machines, attract packages can be displayed on the machines and on displays associated with the machines for games that will soon be available. For example, a player that engages in playing the first episode in a series of games may be permitted to view an attract package associated with the second episode in the series before the second episode is available for play.

Figure 1:
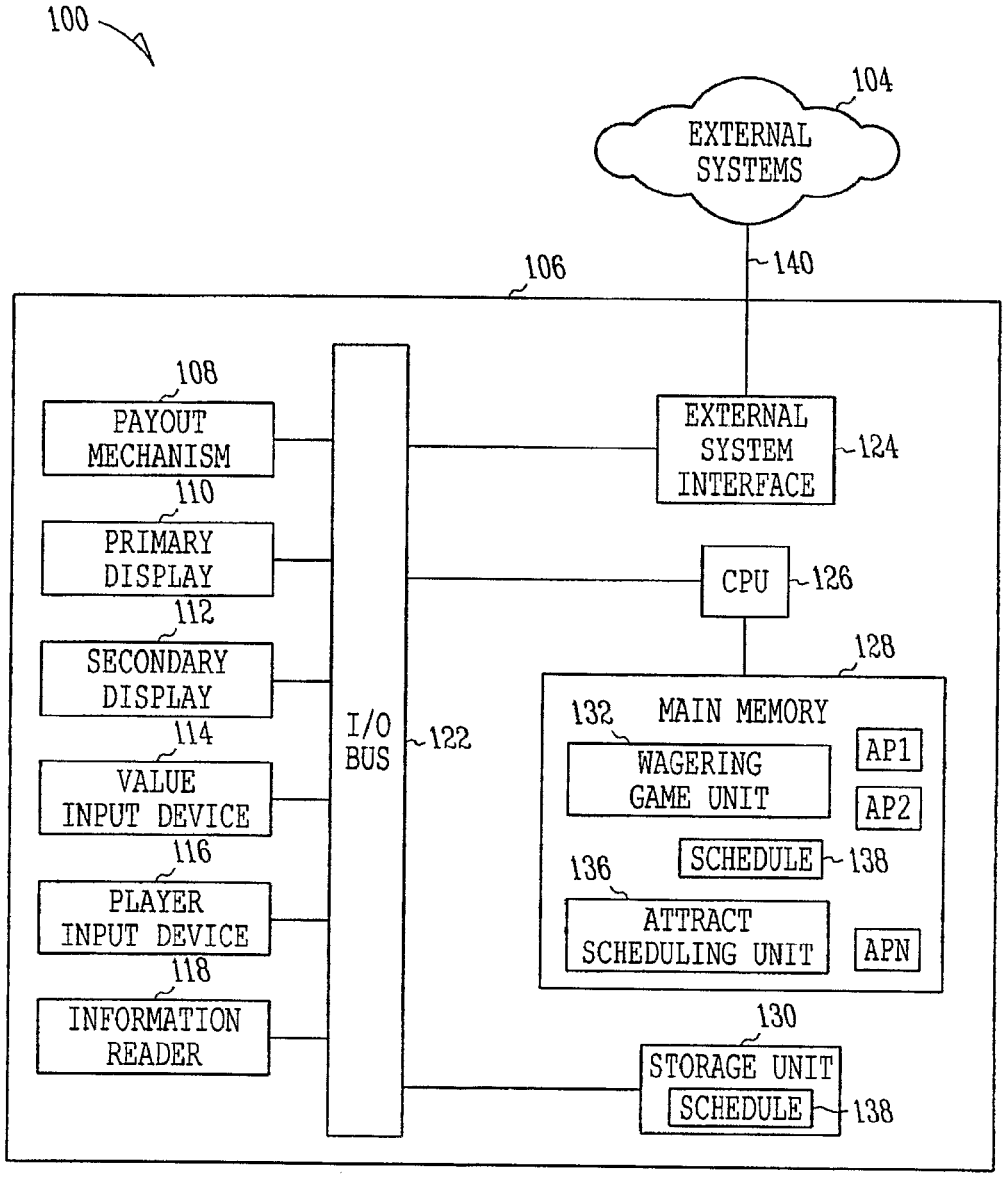
FIG. 1 is a block diagram of a wagering apparatus and a wagering game machine, according to example embodiments of the invention.

FIG. 1 is a block diagram illustrating a wagering apparatus 100 and a wagering game machine 106, according to example embodiments of the invention.

As shown in FIG. 1, the wagering game machine 106 may include a central processing unit (CPU) 126 connected to main memory 128, which includes a wagering game unit 132 and an attract scheduling unit 136. In some embodiments, the wagering game unit 132 can receive wagers and conduct wagering games, such as video poker, video black jack, video slots, video lottery, etc. In some embodiments, the attract scheduling unit 136 can schedule the download and display of pertinent attract packages, as described herein. One or more attract packages AP1, AP2, . . . , APN may be received by the wagering game machine 106, and may be stored in a memory, such as the main memory 128, or the storage unit 130.

The CPU 126 may also be connected to an input/output (I/O) bus 122, which facilitates communication between the wagering game machine's components. The I/O bus 122 may be connected to a payout mechanism 108, a primary display 110, a secondary display 112, a value input device 114, a player input device 116, an information reader 118, and one or more storage units 130. The player input device 116 may include the value input device 114, to the extent that the player input device 116 is used to place wagers. In some embodiments, the value input device 114 can electronically receive wagering value (e.g., monetary value) from a player's casino account or other suitable "cashless gaming" value source. The I/O bus 122 may also be connected to an external system interface 124, perhaps comprising a network interface card and/or a wireless transceiver, which may in turn be connected to external systems 104 (e.g., wagering game networks) via a wired or wireless connection 140.

In some embodiments, the wagering game machine 106 can include additional peripheral devices and/or more than one of each component shown in FIG. 1. For example, in some embodiments, the wagering game machine 106 can include several external system interfaces 124 and multiple CPUs 126. In some embodiments, any of the components can be integrated or subdivided. Additionally, in some embodiments, the components of the wagering game machine 106 can be interconnected according to any suitable interconnection architecture (e.g., directly connected, in series, in parallel, hypercube, etc.).

In some embodiments, any of the components of the wagering game machine 106 (e.g., the attract scheduling unit 136) can include hardware, firmware, and/or software for performing the operations described herein. Furthermore, any of the components can include machine-readable media including instructions for causing a machine to perform the operations described herein. Machine-readable media includes any mechanism, such as the main memory 128 and the storage unit 130, that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any medium suitable for transmitting software over a network.

Thus, many embodiments may be realized. For example, a wagering apparatus 100 may comprise a wagering game machine 106 having a wagering game unit 132 operable to receive a wager in association with a wagering game. The wagering apparatus 100 may also comprise an attract scheduling unit 136 operable to use at least one schedule 138 to manage the presentation of at least one attract package (e.g., AP1) on the wagering game machine 106.

In some embodiments, the wagering apparatus 100 may include a memory 128 as a part of the wagering game machine 106, the memory 128 being configured to store a plurality of attract packages AP1, AP2, . . . , APN. Some embodiments of the wagering apparatus 100 may have a wired or wireless transceiver (e.g., as part of the external system interface 124) included in the wagering game machine 106, and/or a value input device 114 to electronically receive wagering value from a cashless gaming value source.

Figure 2:
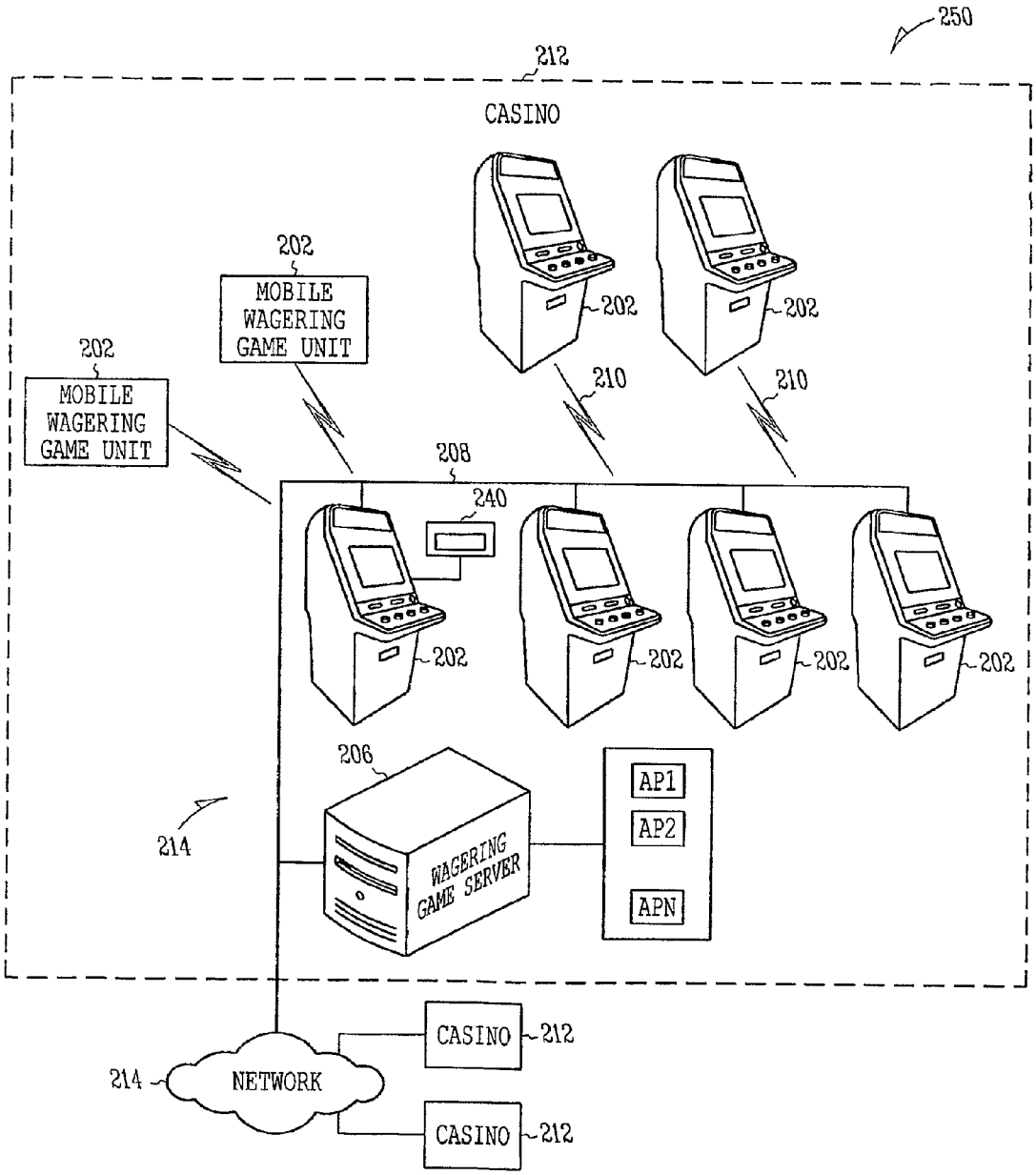
FIG. 2 is a block diagram illustrating a wagering game network, according to example embodiments of the invention.

While FIG. 1 describes example embodiments of a wagering game machine, FIG. 2 shows how a plurality of wagering game machines 202 can be connected in a wagering game network 200.

FIG. 2 is a block diagram illustrating a wagering game network 200, according to example embodiments of the invention. As shown in FIG. 2, the wagering game network 200 includes a plurality of casinos 212 connected to a communications network 214.

Each of the plurality of casinos 212 may include a local area network 208, which includes wagering game machines 202 connected to a wagering game server 206 that may serve wagering games and attract packages AP1, AP2, . . . , APN over the network 208. The wagering game machines 202 and the wagering game server 206 can include hardware and machine-readable media including instructions for conducting attract scheduling operations, as described herein. The wagering game machines 202 may be similar to or identical to the wagering game machine 106 illustrated in FIG. 1. In some embodiments, the wagering game server 206 can perform attract scheduling in concert with serving wagering games over the wagering game network 200.

The wagering game machines 202 described herein can take any suitable form, such as floor standing models, mobile units, handheld mobile units, bartop models, workstation-type console models, etc. Further, the wagering game machines 202 may be primarily dedicated for use in conducting wagering games, or may comprise a non-dedicated device, such as a mobile phone, personal digital assistant, personal computer, etc. In some embodiments, the wagering game network 200 can include other network devices, such as accounting servers, wide area progressive servers, player tracking servers, and/or other devices suitable for use in connection with embodiments of the invention.

The components of each casino 212 can communicate over wired 208 and/or wireless connections 210. Furthermore, they can employ any suitable connection technology, such as Bluetooth, 802.11, Ethernet, public switched telephone networks, SONET, etc.

In some embodiments, one or more attract packages AP1, AP2, . . . , APN are stored at a wagering game server 206. An attract package (e.g., AP1) can include video and audio produced to advertise features of a game. Typically, an attract package is presented on a game machine 202. However, in some embodiments, an attract package can be presented on an audio/visual (AV) unit, such as a television or monitor, that is associated with the game machine 202, and physically separated, but electronically coupled to it. In some embodiments, one or more attract packages AP1, AP2, . . . , APN are communicated from a server (e.g., a wagering game server 206) to a client (e.g., a wagering game machine 202) using either a "push" or "pull" transfer mode. A push transfer mode is provided when, for example, an administrator initiates a transfer (i.e., download) of an attract package (e.g., AP1) at a server and the attract package is "pushed" out to one or more clients (e.g., wagering games machines 202) on the network 200. A pull transfer mode is provided by initiating a request to the server 206 for an attract package download from a client machine (e.g., a game machine 202).

Referring now to FIGS. 1 and 2, it can be seen that additional embodiments may include a system 250 comprising one or more wagering apparatus 100, as described above with respect to FIG. 1, as well as a server 206 (e.g., a wide area progressive server) to transmit one or more attract packages AP1, AP2, . . . , APN to the apparatus 100. Some embodiments may include an audio-visual unit 240 disposed apart from the apparatus 100 (e.g., comprising a wagering game machine 106, 202) and electronically coupled to the apparatus 100 to display attract packages AP1, AP2, . . . , APN. The system 250 may also include a wired network 208 to couple the server 206 to the apparatus 100 and to serve as a transmission medium for the attract packages AP1, AP2, . . . , APN from the server 206 to the apparatus 100.

Any of the components previously described can be implemented in a number of ways, including simulation via software. Thus, the wagering apparatus 100; wagering game machine 106; payout mechanism 108; primary display 110; secondary display 112; value input device 114; player input device 116; information reader 118; I/O bus 122; external system interface 124; CPU 126; main memory 128; storage unit 130; wagering game unit 132; attract scheduling unit 136; connection 140; wagering game machines 202; wired connection 208; wireless connection 210; casinos 212; communications network 214; system 250; and attract packages AP1, AP2, . . . , APN may all be characterized as "modules" herein.

These modules may include hardware circuitry, single or multi-processor circuits, memory circuits, software program modules and objects, firmware, and combinations thereof, as desired by the architect of the apparatus 100 and systems 250, and as appropriate for particular implementations of various embodiments. In some embodiments, the modules may be included in a system operation simulation package such as a software electrical signal simulation package, a power usage and distribution simulation package, a network security simulation package, a power/heat dissipation simulation package, a signal transmission-reception simulation package, or any combination of software and hardware used to simulate the operation of various potential embodiments. Such simulations may be used to characterize or test the embodiments, for example.

It should also be understood that the apparatus and systems of various embodiments can be used in applications other than wagering game machines. Thus, various embodiments of the invention are not to be so limited. The illustrations of apparatus 100 and systems 250 are intended to provide a general understanding of the structure of various embodiments, and they are not intended to serve as a complete description of all the elements and features of apparatus and systems that might make use of the structures described herein.

Applications that may include the novel apparatus and systems of various embodiments include electronic circuitry used in high-speed computers, communication and signal processing circuitry, modems, single or multi-processor modules, single or multiple embedded processors, and application-specific modules, including multilayer, multi-chip modules. Such apparatus and systems may further be included as sub-components within a variety of electronic systems, such as data bridges, switches, and hubs; televisions and cellular telephones; personal computers and workstations; medical devices; radios and video players; and vehicles, among others.

Example Operations

Figure 3:
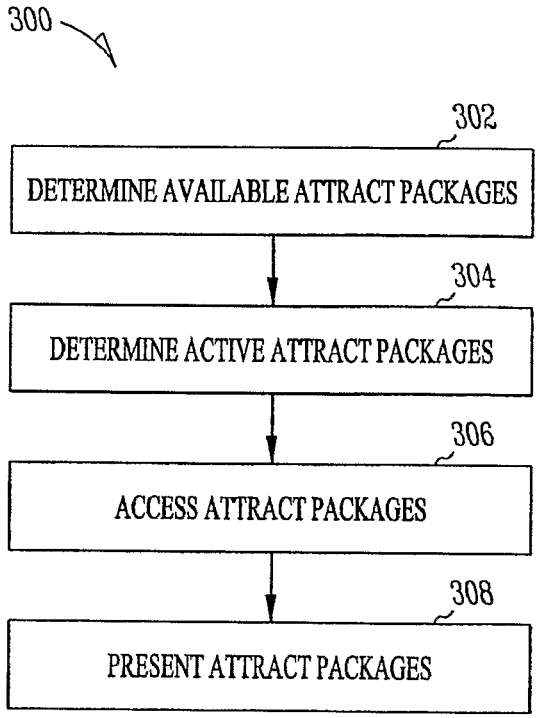
FIG. 3 is a flowchart illustrating various methods of managing attract packages, according to example embodiments of the invention.

FIG. 3 is a flowchart illustrating various methods 300 of managing attract packages. At block 302, the method 300 determines which attract packages are currently available (e.g., accessible to a wagering game apparatus). In some embodiments, a game machine 202 can access a wagering game server 206 to determine which attract packages are available.

Once available attract packages are determined to exist (e.g., located within a particular wagering game machine or associated server, or via a network connection), the method 300 may then proceed with determining which available attract packages are active at block 304. To periodically introduce new content on a game machine 202, attract packages can be activated by one or more operations, not necessarily related to wagering activity. In some embodiments, an attract package can be automatically activated after a certain amount of time. For example, an episode may comprise an individual game, or a game may be partitioned into multiple episodes. In either case, the attract package for a second episode can be automatically activated two months after the release of the first episode. In another example, an attract package for a later episode can be activated some fixed time after a previous episode has been made available for play.

In some embodiments, an attract package can be activated based on a fixed date and time. For example, an attract package for "Episode 4" can be activated on a specific day, e.g., "Jun. 14, 2006." In such an example, the amount of time a casino has used a previous episode (e.g., "Episode 3") or the amount of time elapsed from the release of the previous episode may be irrelevant to the activation date of Episode 4. In other cases, the elapsed time may be directly related to whether a particular package is active.

In some embodiments, the activation date, which can optionally include a specific time, is hard coded in a game package. For example, an attract package for Episode 4 can be bundled with the game distribution package for Episode 3 (e.g., on a DVD). Upon executing an install routine for the game Episode 3 distribution package, the attract package for the later episode (e.g., Episode 4) may also be installed and set to activate at a certain time.

In some embodiments, the activation date can be provided. For example, the activation date can be provided by an administrator or technician. In some embodiments, the activation date may be provided directly to the game machine 202 by the administrator or technician. In some embodiments, the activation date may be available on a wagering game server 206 and delivered to or retrieved by the game machine 202, as initiated by either the server 206 or the game machine 202.

At block 306, after the method 300 has determined which available attract packages are active, the available active attract packages may be accessed. In some embodiments, several attract packages can exist on a game machine 202 at the same time. The game machine 202 can use the attract scheduling unit 136 to manage the appearance of such attract packages. In some embodiments, attract packages are transferred to a game machine 202 at the time that the attract packages are to be activated. In some embodiments, attract packages are transferred occasionally or periodically and although the package is located locally on the game machine 202, the package is made active (i.e., displayed) based on a separate schedule, perhaps stored on a server. For example, attract packages can be downloaded nightly, or at any scheduled convenient time, to game machines. This may serve to reduce network loading during busy periods. In some embodiments, attract packages may be streamed from a download server (e.g., a game server 206) to the game machine 202.

At block 308, the attract package may be presented on a display device. In some embodiments, the attract package may be accessed from a local copy. Typically, the local copy has been downloaded from a source, such as a game server 206, and exists at the game machine 202 for faster access. The local copy can also be installed directly on the game machine 202, such as by using a CD-ROM or DVD to load the attract package. In some embodiments, the attract packages may be streamed from a source (e.g., a game server 206) each time the attract package is presented on the display device. A streaming download mode can reduce local storage requirements and increase flexibility of operation; however, streaming can also increase network bandwidth requirements.

In some embodiments, game machines 202 will only attempt to access, download, or present an attract package that is relevant to a game or games that will be operable on a particular game machine 202. In some embodiments, a game machine 202 may attempt to access and present attract packages that are relevant based on other factors, such as a common production company, a common casino provider, or a common genre.

Additional embodiments may include (e.g., in a wagering game machine operable to receive a wager associated with a wagering game) a method that comprises determining the availability of one or more attract packages, and, if one of the attract package comprises an available attract package, determining whether the available attract package comprises an active attract package based on one or more schedules. The method may also comprise, if the available attract package comprises an active attract package, accessing the active attract package and presenting the active attract package, perhaps by presenting the available attract package at an audio-visual unit physically separated from the wagering game machine, or by displaying the active attract package on a display integral with the wagering game machine. In some embodiments, the method may include pushing at least one non-available attract package from a server to the wagering game machine, and/or pulling at least one non-available attract package from a server into the wagering game machine.

The method may also include automatically activating an available attract package to provide an active attract package. Automatically activating the available attract package may include, in turn, activating the available attract package at a fixed time after release of an associated gaming episode, and/or activating the available attract package at a fixed time after a release date of an associated prior gaming episode.

In some embodiments, the method may include installing one or more attract packages on a wagering game machine along with an associated prior gaming episode. The method may also include downloading attract packages to the wagering game machine according to a schedule, and/or streaming a copy of one or more attract packages to a plurality of wagering game machines. In some embodiments, the method may include receiving the one or more attract packages at the wagering game machine according to a first schedule and activating the one or more attract packages according to a second schedule.

The methods described herein do not have to be executed in the order described, or in any particular order. Moreover, various activities described with respect to the methods identified herein can be executed in repetitive, serial, or parallel fashion. Information, including parameters, commands, operands, and other data, can be sent and received in the form of one or more carrier waves.

One of ordinary skill in the art will understand the manner in which a software program can be launched from a computer-readable medium in a computer-based system to execute the functions defined in the software program. Various programming languages may be employed to create one or more software programs designed to implement and perform the methods disclosed herein. The programs may be structured in an object-orientated format using an object-oriented language such as Java or C++. Alternatively, the programs can be structured in a procedure-orientated format using a procedural language, such as assembly or C. The software components may communicate using a number of mechanisms well known to those skilled in the art, such as application program interfaces or interprocess communication techniques, including remote procedure calls. The teachings of various embodiments are not limited to any particular programming language or environment.

Thus, other embodiments may be realized, including a machine-readable medium encoded with instructions for directing a machine to perform operations comprising any of the methods described herein. For example, some embodiments may include a machine-readable medium encoded with instructions for directing a wagering game machine operable to receive a wager to perform a variety of operations. Such operations may include determining the availability of one or more attract packages, and determining whether any of the available attract packages comprises an active attract package based on one or more schedules. The operations may further include, if any of the available attract packages comprises an active attract package, accessing the active attract package and presenting the active attract package. Other operations may include any of the activities presented in conjunction with the methods described above.

Example Wagering Game Machine

Figure 4:
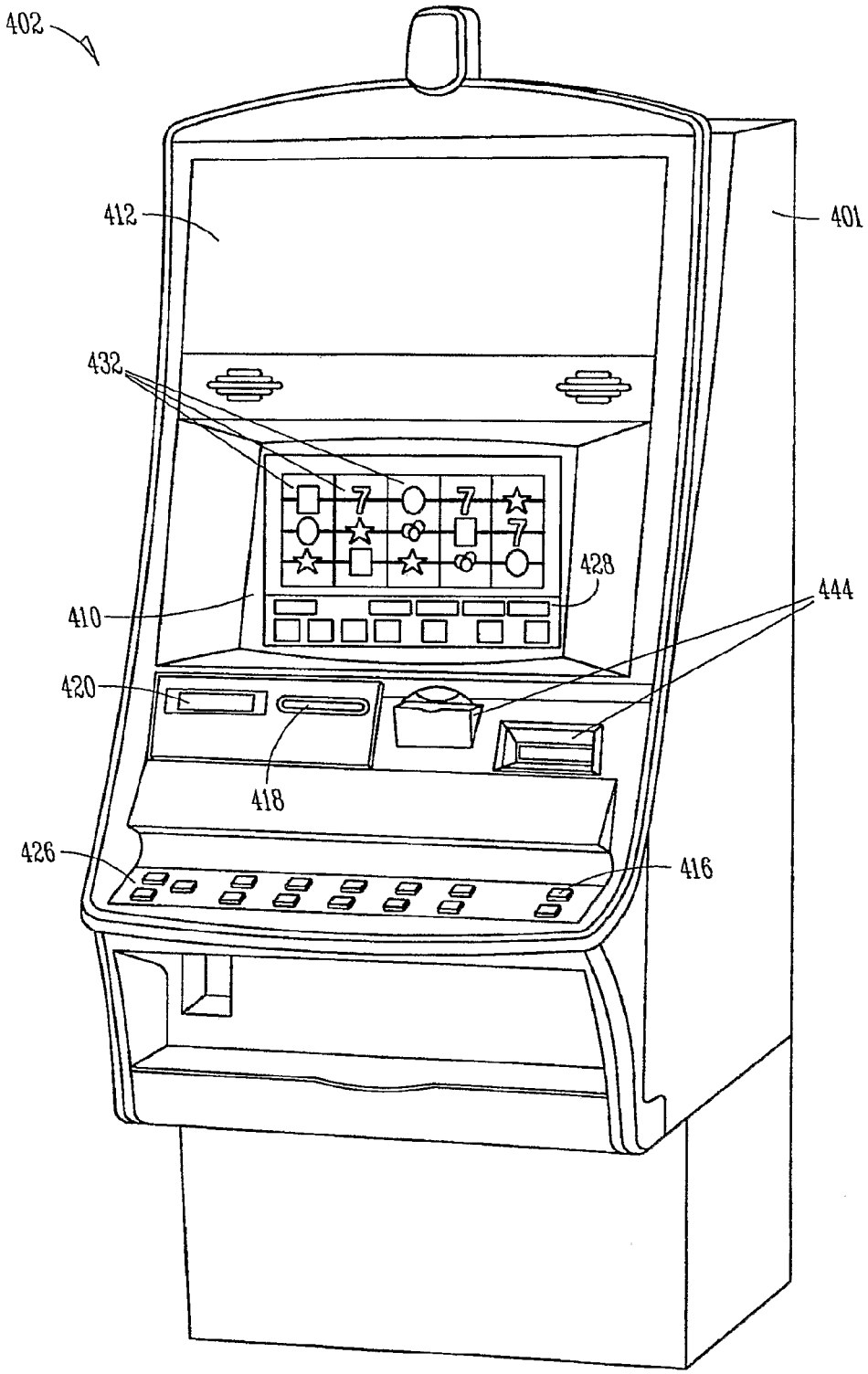
FIG. 4 is a perspective view of a wagering game machine, according to example embodiments of the invention.

FIG. 4 is a perspective view of a wagering game machine, according to example embodiments of the invention. Referring to FIG. 4, the wagering game machine 402 (which may be similar to or identical to the machines 106, 202 described above) may be used in gaming establishments, such as casinos. According to some embodiments, the wagering game machine 402 can be any type of wagering game machine and can have varying structures and methods of operation. For example, the wagering game machine 402 may comprise an electromechanical wagering game machine configured to play mechanical slots, or it may comprise an electronic wagering game machine configured to play video casino games, such as blackjack, slots, keno, poker, blackjack, roulette, etc.

The wagering game machine 402 may comprise a housing 401 and include input devices, such as wager input devices 444 (perhaps coupled to a value input device 114, shown in FIG. 1), and a player input device 416. For output, the wagering game machine 402 may include a primary display 410 for displaying information about a basic wagering game. The primary display 410 can also display information about a bonus wagering game, a progressive wagering game, and one or more attract packages. The wagering game machine 402 may also include a secondary display 412 for displaying wagering game events, wagering game outcomes, attract packages, and/or signage information. While some components of the wagering game machine 402 are described herein, numerous other elements can exist and can be used in any number or combination to create varying forms of the wagering game machine 402.

The wager input devices 444 can take any suitable form and may be located on the front of the housing 401. The wager input devices 444 can receive currency and/or credits inserted by a player. The wager input devices 444 can include coin acceptors for receiving coin currency and bill acceptors for receiving paper currency. Additionally, the wager input devices 444 can include ticket readers or barcode scanners for reading information stored on vouchers, cards, or other tangible portable storage devices. The vouchers or cards can authorize access to central accounts, which can transfer money to the wagering game machine 402. Some wagering game machines 402 may utilize RFID technology to passively identify players and accept payment using an RFID carried by a player without the player having to carry out specific actions or enter anything physical into the game.

The player input device 416 may comprise a plurality of push buttons on a button panel 426 for operating the wagering game machine 402. In addition, or alternatively, the player input device 416 can comprise a touch screen 428 mounted over the primary display 410 and/or secondary display 412.

The various components of the wagering game machine 402 can be connected directly to, or contained within, the housing 401. Alternatively, some of the wagering game machine's components can be located outside of the housing 401, while being communicatively coupled with the wagering game machine 402 using any suitable wired or wireless communication technology. This includes an audio-visual unit, for example.

The operation of the basic wagering game can be displayed to the player on the primary display 410. The primary display 410 can also display a bonus game associated with the basic wagering game. The primary display 410 may include a cathode ray tube (CRT), a high resolution liquid crystal display (LCD), a plasma display, light emitting diodes (LEDs), or any other type of display suitable for use in the wagering game machine 402. Alternatively, the primary display 410 can include a number of mechanical reels to display the outcome. In FIG. 4, the wagering game machine 402 is shown as an "upright" version in which the primary display 410 is oriented vertically relative to the player. Alternatively, the wagering game machine can be a "slant-top" version in which the primary display 410 is slanted at about a thirty-degree angle toward the player of the wagering game machine 402. In yet another embodiment, the wagering game machine 402 can be a bartop model, a mobile unit, a handheld mobile unit, a gaming device in a server-based system, or a workstation-type console model, among others.

A player may begin playing a basic wagering game by placing a wager via the player input device 416 and/or the wager input device 418. The player can initiate play by using the push buttons or the touch screen 428 or the player input device 416. The basic game can include arranging a plurality of symbols along a payline 432, which indicates one or more outcomes of the basic game. Such outcomes can be randomly selected in response to player input. At least one of the outcomes, which can include any variation or combination of symbols, can trigger the occurrence of a bonus game.

In some embodiments, the wagering game machine 402 can also include an information reader 420, which can include a card reader, ticket reader, bar code scanner, RFID transceiver, or computer readable storage medium interface. In some embodiments, the information reader 420 can be used to award complimentary services, restore game assets, track player habits, etc.

Implementing the apparatus, systems, and methods disclosed herein may operate to provide a more interesting game playing experience. This is because attract packages may be scheduled for presentation to players so that imminently available games, perhaps related to the game currently being played, are anticipated prior to the upcoming release date.

General Comments

In the following detailed description, reference is made to specific examples by way of drawings and illustrations. These examples are described in sufficient detail to enable those skilled in the art to practice the inventive subject matter, and serve to illustrate how the inventive subject matter may be applied to various purposes or embodiments. Other embodiments are included within the inventive subject matter, as logical, mechanical, electrical, and other changes may be made to the example embodiments described herein. Features or limitations of various embodiments described herein, however essential to the example embodiments in which they are incorporated, do not limit the inventive subject matter as a whole, and any reference to the invention, its elements, operation, and application are not limiting as a whole, but serve only to define these example embodiments.

Such embodiments of the inventive subject matter may be referred to herein individually or collectively by the term "invention" merely for convenience and without intending to voluntarily limit the scope of this application to any single invention or inventive concept, if more than one is in fact disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted to require more features than are expressly recited in each claim. Rather, inventive subject matter may be found in less than all features of a single disclosed embodiment. Thus the following claims are hereby incorporated into the Detailed Description, with each claim standing on its own as a separate embodiment.

What is claimed is:

1. An apparatus comprising:

a wagering game machine having a wagering game unit operable to receive a wager in association with a wagering game, the wagering game machine being configured to present a series of gaming episodes comprising individual games in a series of games or individual partitions of a single game in a series of partitions; and an attract scheduling unit operable to activate at least one attract package on the wagering game machine, the at least one attract package associated with a later episode in the series of gaming episodes, the attract scheduling unit to activate the at least one attract package prior to availability of the later episode in the series of gaming episodes for play on the wagering game machine and after a previous episode in the series of gaming episodes has been made available for play on the wagering game machine.

2. The apparatus of claim 1, further including:

a wired network interface included in the wagering game machine.

3. The apparatus of claim 1, further including:

a memory included in the wagering game machine, the memory to store a plurality of attract packages including the at least one attract package.

4. The apparatus of claim 1, further including:

a wireless transceiver included in the wagering game machine.

5. The apparatus of claim 1, further including:

a value input device to electronically receive wagering value from a cashless gaming value source.

6. A system, comprising:

an apparatus comprising a wagering game machine having a wagering game unit operable to receive a wager in association with a wagering game, the wagering game machine being configured to present a series of gaming episodes comprising individual games in a series of games or individual partitions of a single game in a series of partitions, and an attract scheduling unit operable to activate at least one attract package on the wagering game machine, the at least one attract package associated with a later episode in the series of gaming episodes, the attract scheduling unit to activate the at least one attract package prior to availability of the later episode in the series of gaming episodes for play on the wagering game machine and after a previous episode in the series has been made available for play on the wagering game machine.

7. The system of claim 6, further including:

an audio-visual unit disposed apart from the apparatus and electronically coupled to the apparatus to display the at least one attract package.

8. The system of claim 6, wherein the server comprises a wide area progressive server.

9. The system of claim 6, further including:

a wired network to couple the server to the apparatus and to serve as a transmission medium for the attract package from the server to the apparatus.

10. A method comprising:

in a wagering game machine operable to receive a wager associated with a wagering game, the wagering game machine being configured to present a series of gaming episodes comprising individual games in a series of games or individual partitions of a single game in a series of partitions, activating at least one attract package on the wagering game machine, the at least one attract package associated with a later episode in the series of gaming episodes, wherein the activating occurs prior to availability of the later episode in the series of gaming episodes for play on the wagering game machine and after a previous episode in the series has been made available for play on the wagering game machine.

11. The method of claim 10, further including:

pushing at least one non-available attract package from a server to the wagering game machine.

12. The method of claim 10, further including:

pulling at least one non-available attract packages from a server into the wagering game machine.

13. The method of claim 10, wherein the presenting further includes :

presenting the at least one attract package as an active attract package at an audio-visual unit physically separated from the wagering game machine.

14. The method of claim 10, wherein the activating includes:

activating the at least one attract package according to a date coded into a game distribution package, or a time coded into the game distribution package, or both.

15. The method of claim 10, wherein the activating includes:

activating the at least one attract package at a fixed time after release of the previous episode.

16. The method of claim 10, wherein the activating includes:

activating the at least one attract package at a fixed time after a release date of the previous episode.

17. The method of claim 10, further including:

installing the at least one attract package on the wagering game machine along with the previous episode.

18. The method of claim 10, further including:

downloading the at least one attract package to the wagering game machine according to a schedule.

19. The method of claim 10, further including:

streaming a copy of the at least one attract package to a plurality of wagering game machines including the wagering game machine.

20. A non-transitory, tangible machine-readable storage medium encoded with instructions for directing a wagering game machine operable to receive a wager and configured to present a series of gaming episodes comprising individual games in a series of games or individual partitions of a single game in a series of partitions to perform operations comprising:

activating at least one attract package on the wagering game machine, the at least one attract package associated with a later episode in the series of gaming episodes, wherein the activating occurs prior to availability of the later episode in the series of gaming episodes for play on the wagering game machine and after a previous episode in the series has been made available for play on the wagering game machine, and presenting the at least one attract package as an active attract package.

21. The tangible machine-readable storage medium of claim 20, wherein presenting the at least one attract package as an active attract package includes:

displaying the active attract package on a display integral with the wagering game machine.

22. The tangible machine-readable storage medium of claim 20, wherein presenting the at least one attract package as an active attract package includes:

receiving the at least one attract package at the wagering game machine according to a first schedule; and activating the at least one attract package according to a second schedule.

* * * * *